United States Patent [19]

Sano et al.

[11] Patent Number: 4,849,397

[45] Date of Patent: Jul. 18, 1989

[54] PRESSURE-SENSITIVE RECORDING MEDIUM

[75] Inventors: Shojiro Sano; Keiso Saeki, both of Shizuoka, Japan

[73] Assignee: Fuji Photo Film Co., Ltd., Kanagawa, Japan

[21] Appl. No.: 262,211

[22] Filed: Oct. 21, 1988

Related U.S. Application Data

[63] Continuation of Ser. No. 77,828, Jul. 27, 1987, abandoned.

[30] Foreign Application Priority Data

Jul. 25, 1986 [JP] Japan ..... 61-173874

[51] Int. Cl.[4] ..... B41M 5/16; B41M 5/22

[52] U.S. Cl. ..... 503/217; 427/151; 428/342; 428/914; 503/210; 503/211; 503/212; 503/220; 503/223; 503/225

[58] Field of Search ..... 427/150–152; 428/341, 342, 913, 914; 503/210–212, 216, 217, 220, 223, 225

[56] References Cited

U.S. PATENT DOCUMENTS

| | | | |
|---|---|---|---|
| 4,295,663 | 10/1981 | Petitpierre et al. | 503/217 |
| 4,508,897 | 4/1985 | Bedekovic et al. | 503/220 |
| 4,688,060 | 8/1987 | Tanaka et al. | 503/214 |

FOREIGN PATENT DOCUMENTS

| | | | |
|---|---|---|---|
| 2041303 | 8/1980 | United Kingdom | 503/220 |
| 2141729 | 1/1985 | United Kingdom | 503/220 |
| 2148923 | 6/1985 | United Kingdom | 503/220 |

*Primary Examiner*—Bruce H. Hess

*Attorney, Agent, or Firm*—Sughrue, Mion, Zinn, Macpeak & Seas

[57] ABSTRACT

A pressure-sensitive recording medium producing a colored image utilizing the reaction between a substantially colorless electron donating dye precursor and an electron accepting developer is disclosed. This recording sheet is characterized in that the electron accepting developer layer contains an aromatic carboxylic acid metal salt and the electron donating dye precursor layer contains (a) an indolylazaphthalide compound and (b) Crystal Violet lactone.

8 Claims, No Drawings

PRESSURE-SENSITIVE RECORDING MEDIUM

This is a continuation of application Ser. No. 077,828 filed July 27, 1987, now abandoned.

FIELD OF THE INVENTION

The present invention relates to a pressure-sensitive recording sheet, and more particularly, to a pressure-sensitive recording sheet in which a colored image is formed upon reaction of a substantially colorless electron donating dye precursor (hereinafter referred to as a "color former") and an electron accepting developer (hereinafter referred to as a "developer").

BACKGROUND OF THE INVENTION

A pressure-sensitive recording material utilizing the reaction between a color former and a developer, for example, clay substances such as acidic clay, activated clay, attapulgite, zeolite, bentonite and kaolin, metal salts of aromatic carboxylic acids, and a phenol-formaldeyde resin is well known as described in, for example, U.S. Pat. Nos. 2,505,470, 2,505,489, 2,550,471, 2,548,366, 2,712,507, 2,730,456, 2,730,457, 3,418,250.

When, however, clay minerals such as acidic clay and activated clay are used as the developer, a serious problem arises in that a colored image is low in light fastness and moisture resistance.

A phenol-formaldehyde resin when used as the developer provides a colored image which is superior in light fastness and moisture resistance to that of the clay minerals. The phenol-formaldehyde resin, however, has the disadvantage that the colored image readily becomes yellow in color when exposed to light and nitrogen oxides.

On the other hand, the metal salts of aromatic carboxylic acids, when used as the developer, provide a colored image which is as high in light fastness and moisture resistance as that of the phenol-formaldehyde resin.

From the viewpoint of light fastness and moisture resistance of a colored image, therefore, it is desirable that the aromatic carboxylic acid methal salts be used as the developer. These aromatic carboxylic acid metal salts, however, have the disadvantage that fastness against platicizers is inferior to that of the clay minerals. Furthermore the light fastness of the colored image is not always sufficiently high.

In recent years, various pressure-sensitive recording sheets utilizing the combinations of indolyl-azaphthalide-based color former and clay minerals or phenol resin developers have been proposed in, for example, U.S. Pat. Nos. 4,275,905, 4,299,411, 4,046,776 and 4,564,679, British Patent Publication Nos. 2,039,934B, 2,082,194B, 2,040,303B, 1,467,098A, 2,075,042B, 2,103,234B and 2,148,923B, European Patent Publication Nos. 82822B and 140833A, Japanese Patent Publication Nos. 38243/76, Japanese Patent Application (OPI) Nos. 224582/85, and 139760/85 (the term "OPI" used herein means a "published unexamined patent application.").

It has been found that where the above-described aromatic carboxylic acid metal salts are used as the developer, if the above-described indolylazaphthalide compound is used as the color former, plasticizer resistance is improved as well as the light fastness and moisture resistance of the colored image. In this case, however, the hue and color density of a colored image are not sufficiently high.

SUMMARY OF THE INVENTION

An object of the present invention is to provide a pressure-sensitive recording sheet which uses the metal salts of aromatic carboxylic acids as the developer and provides a colored image which is excellent in light fastness, moisture resistance and plasticizer resistance, and a colored image which is excellent in hue and color density.

As a result of extensive investigation, it has been found that in a system in which the metal salts of aromatic carboxylic acids are used as the developer, if Crystal Violet lactone is used in combination with the indolylazaphthalide compound as the color former, the hue and color density of the colored image can be markedly improved while maintaining excellent light-fastness, moisture resistance and plasticizer resistance of the colored image. Based on the above findings, the present invention has been accomplished.

The present invention provides a pressure-sensitive recording medium which produces a colored image comprising a substantially colorless electron donating dye precursor layer and an electron accepting developer layer, wherein the electron accepting developer layer contains an aromatic carboxylic acid metal salt and the electron donating dye precursor layer contains (a) an indolylazaphthalide compound and (b) Crystal Violet lactone.

DETAILED DESCRIPTION OF THE INVENTION

The metal salts of aromatic carboxylic acids which are used in the developer layer of the present invention are described in, for example, U.S. Pat. Nos. 3,864,146, 3,983,292, and Japanese Patent Publication No. 4354/86.

In the above aromatic carboxylic acid metal salts, aromatic carboxylic acids having a hydroxyl group in the ortho- or para-position relative to the carboxyl group are particularly useful. In particular, salicylic acid derivatives are preferred. Particularly preferred are compounds having a substituent, such as an alkyl group, an aryl group or an aralkyl group, in at least one of the ortho- and para-positions relative to the hydroxyl group and having a total number of carbon atoms in the substituent of not less than 8.

Particularly preferred aromatic carboxylic acids include 3,5-di-tert-butylsalicylic acid, 3,5-didodecylsalicylic acid, 3-phenyl-5-(α,α-dimethylbenzyl)salicylic acid, 4-benzyloxysalicylic acid, 4-β-phenethyloxysalicylic acid, 5-(p'-α'-methylbenzyl-p-α-methylbenzyl)-salicylic acid, 5-α-(α-methylbenzyl}phenethylsalicylic acid, 3,5-ditert-amylsalicylic acid, 3,5-bis(α,α-dimethylbenzyl)salicylic acid, 3,5-bis(α-methylbenzyl)salicylic acid, 3-(α-methylbenzyl)-5-(α,α-dimethylbenzyl) salicylic acid, 3,5-di-tert-octylsalicylic acid and 3-cyclohexyl-5-(α,αdimethylbenzyl)salicylic acid.

Metals which form the metal salts in combination with the above aromatic carboxylic acids include magnesium, aluminum, calcium, scandium, titanium, vanadium, chromium, manganese, iron, cobalt, nickel, copper, zinc, potassium, germanium, strontium, yttrium, zirconium, molybdenum, cadmium, indium, antimony, barium and tin. Of these metals, zinc, aluminum and calcium are preferred. Particularly preferred is zinc.

The aromotic carboxylic acid metal salts may be used in the form of a dispersion or an emulsion.

The dispersion of the aromatic carboxylic acid metal salts is prepared by mechanically dispersing the aromatic carboxylic acid metal salts in a water by the use of a ball mill, an attritor and a sand mill, for example.

In preparation of the dispersion, a dispersing agent, a surface active agent and the like may be added.

The emulsion of the aromatic carboxylic acid metal salt is prepared by dissolving the aromatic carboxylic acid metal salt in an organic solvent and emulsifying the resulting solution in water. Organic solvents which can be used are solvents capable of dissolving the aromatic carboxylic acid metal salts in a proportion of not less than 10% by weight. Examples thereof are aliphatic or aromatic esters, biphenyl derivatives, naphthalene derivatives and diphenylalkanes.

The dispersion of the aromatic carboxylic acid metal salts and the emulsion of the aromatic carboxylic acid metal salts can be used in combination with each other in any desired proportion.

In preparation of a coating solution, if an inorganic pigment, such as titanium oxide, zinc oxide, silicon oxide, calcium oxide, calcium carbonate, aluminum hydroxide, kaolin, activated clay, talc and barium sulfate, is used in combination with a dispersion, an emulsion, or a combination of a dispersion and an emulsion of an aromatic carboxylic acid metal salt, desirable effects such as increased coating suitability, covering power, developability and so forth can be obtained. If the above inorganic pigment is dispersed by the use of a medium dispersion machine, such as a sand mill, a ball mill and an attritor, desirable effects such as increased developability, quality of the coated surface and so forth can be obtained. The amount of the inorganic pigment used in combination is preferably 1 to 100 parts by weight, more preferably 2 to 50 parts by weight per part by weight of the aromatic carboxylic acid metal salt.

The coating solution thus prepared may be mixed with a binder and then coated on a support to obtain a developer sheet.

Binders which can be used include synthetic or natural polymeric substances such as latexes, e.g., a styrene-butadiene copolymer latex, polyvinyl alcohol, a maleic anhydride-styrene copolymer, starch, casein, gum arabic, gelatin, carboxymethyl cellulose and methyl cellulose.

As a support, a paper, a synthetic paper, a plastic film and the like can be used.

The coating solution is coated on a support by known coating method, such as air knife coating, blade coating and curtain coating.

The amount of the aromatic carboxylic acid metal salt coated on a support is 0.1 to 3.0 g/m$^2$ and preferably 0.2 to 1.0 g/m$^2$.

As the indolylazaphthalide compound to be used in the color former layer of the present invention, compounds represented by the following general formula are preferred.

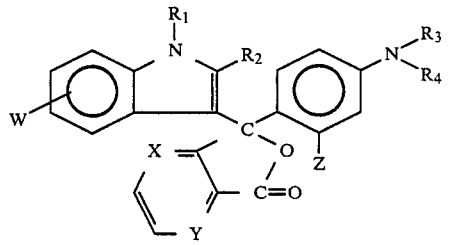

wherein one of X and Y represents —N= and the other represents —CH=; Z represents a hydrogen atom, a halogen atom, an alkyl group having from 1 to 8 carbon atoms, an alkoxy group having from 1 to 12 carbon atoms, an aryloxy group having from 6 to 18 carbon atoms or an aralkyloxy group having from 7 to 18 carbon atoms; W represents a hydrogen atom or a halogen atom; $R_1$ represents a hydrogen atom or an alkyl group having not more than 12 carbon atoms which is unsubstituted or substituted with a halogen atom, a hydroxyl group, a cyano group or a lower alkoxy group; $R_2$ represents a hydrogen atom, an alkyl group having from 1 to 8 carbon atoms or a phenyl group; and $R_3$ and $R_4$ each independently represents a hydrogen atom or an alkyl group, a cycloalkyl group having from 5 to 7 carbon atoms, a benzyl group or a phenyl group which is unsubstituted or substituted with a halogen atom, a hydroxyl group, a cyano group or a lower alkoxy group, and further $R_3$ and $R_4$ may combine to form a pyrrolidinyl group.

Preferred examples of the indolylazaphthalide compounds represented by the above general formula are shown in Table 1 below.

TABLE 1

| | Substituents of Indolylazaphthalide compound represented by formula (I) | | | | | |
|---|---|---|---|---|---|---|
| Compound No. | $R_1$ | $R_2$ | $R_3$ | $R_4$ | Z | W |
| I | (n)-$C_8H_{17}$ | —$CH_3$ | —$C_2H_5$ | —$C_2H_5$ | —$OC_2H_5$ | H |
| II | —$C_2H_5$ | —$CH_3$ | —$C_2H_5$ | —$C_2H_5$ | —$OC_6H_{13}$ | H |
| III | —$C_2H_5$ | —$CH_3$ | —$C_2H_5$ | —$C_2H_5$ | —$OC_2H_5$ | H |
| IV | —$C_2H_5$ | —$CH_3$ | —$C_2H_5$ | —$C_2H_5$ | —$OC_5H_{11}$ | H |
| V | -(iso)-$C_5H_{11}$ | —$CH_3$ | —$C_2H_5$ | —$C_2H_5$ | —$OCH_3$ | H |
| VI | -(n)-$C_5H_{11}$ | —$CH_3$ | —$C_2H_5$ | —$C_2H_5$ | —$OC_3H_7$ | H |
| VII | -(n)-$C_8H_{17}$ | —$CH_3$ | 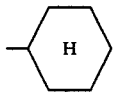 | —$CH_3$ | —$OC_2H_5$ | H |
| VIII | -(n)-$C_8H_{17}$ | —$CH_3$ | 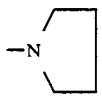 | | —$OC_2H_5$ | H |

TABLE 1-continued

| Compound No. | Substituents of Indolylazaphthalide compound represented by formula (I) | | | | | |
|---|---|---|---|---|---|---|
| | $R_1$ | $R_2$ | $R_3$ | $R_4$ | Z | W |
| IX | $-C_2H_5$ | 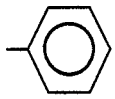 | $-C_2H_5$ | $-C_2H_5$ | $-OC_2H_5$ | H |
| X | $-C_2H_5$ | 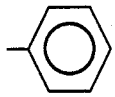 | -(n)-$C_4H_9$ | -(n)-$C_4H_9$ | $-OC_2H_5$ | H |

In the electron donating dye precursor layer, also referred to herein as the color former layer of the present invention, the above-described indolylazaphthalide compound (a) and Crystal Violet lactone (b) are used as the color formers. The weight ratio of (a) to (b) is 5/95 to 90/10 and preferably 15/85 to 75/25.

If the amount of the indolylazaphthalide compound used is too small, the light fastness and plasticizer resistance of the colored image are low. If the amount of the Crystal Violet lactone used is too small, the hue of the color produced differs undesirably from blue and the color density is low.

As the color former, as well as the above-described components (a) and (b), triphenylmethanephthalide compounds, fluoran compounds, phenothiazine compounds, indolylphthalide compounds, leuco auramine compounds, rhodamine lactam compounds, triphenylmethane compounds triazene compounds spiropyran compounds and so forth can be used in combination.

In order to obtain the above-described improvement of characteristics, it is desirable that the amount of the components (a) and (b) together be not less than 60% by weight based on the total weight of the colorformers in the pressure-sensitive recording medium.

The color former that is used in the present invention is preferably encapsulated by dissolving in a solvent and forming capsule walls around solvent droplets or dispersing in a binder solution and then coating on a support.

As the solvent, natural or synthetic oils can be used alone or in combination with each other. Examples of the solvents include cotton seed oil, kerosene, paraffin, naphthenic oils, alkylated biphenyls, alkylated terphenyls, chlorinated paraffins, alkylated naphthalenes, and diphenylalkanes.

Color former-containing microcapsules can be prepared by techniques such as the interfacial polymerization method, the internal polymerization method, the phase separation method, the external polymerization method and the coacervation method.

In preparing a coating solution containing the color former-containing microcapsules, a water-soluble binder or a latex binder is generally used. Specific examples of the water-soluble binder include polyvinyl alcohol, polyvinylpyrrolidone, polyacrylic acid, polyacrylaminde, starch, carboxymethyl cellulose. Specific examples of the latex binder include styrene-butadiene latex, acrylonitrile-butadiene latex, acrylic acid ester type latex.

In addition, a capsule protecting agent, such as cellulose powder, starch particles, talc, calcium carbonate and kaolin, is added to form color former containing microcapsules.

The coating solution is coated on a support to obtain a color former sheet in the same manner as the preparation of the developer sheet.

In the color former layer, the coating amount of the components (a) and (b) is preferably 0.003 to 0.12 g/m$^2$, 0.006 to 0.12 g/m$^2$, respectively. The total amount of the components (a) and (b) is preferably 0.03 to 0.14 g/m$^2$.

The present invention is described in greater detail with reference to the following examples, which are not meant to limit the scope of the invention,. Unless otherwise indicated, all parts, percents and the like are by weight.

EXAMPLES 1 to 11 AND COMPARATIVE EXAMPLES 1 to 10

Preparation of Color Former-containing Microcapsule Sheet

Five parts of a partial sodium salt of polyvinylbenzene sulfonic acid (VERSA TL500 produced by National Starch Co., Ltd.; average molecular weight: 500,000) was dissolved in 95 parts of hot water maintained at about 80° C. by adding the VERSA TL500 to the hot water while stirring. After the sodium salt was dissolved over a period of about 30 minutes, the resulting solution was cooled. The pH of the aqueous solution was 2–3. The pH of the aqueous solution was adjusted to pH 4.0 by adding a 20 wt % aqueous solution of sodium hydroxide.

An indolylazaphthalide compound (a) and Crystal Violet lactone (b) and, in some cases, one or more dyes other than the compounds (a) and (b) as shown in Table 2 were dissolved in 100 parts of diisopropylnaphthalene and then emulsified and dispersed in 100 parts of a 5% aqueous solution of partial sodium salt of the above polyvinylbenzene sulfonic acid to prepare an emulsion having an average particle size of 4.5 μm.

Six parts of melamine, 11 parts of a 37% aqueous solution of formaldehyde and 30 parts of water were stirred while heating at 60° C. In 30 minutes, a clear aqueous solution of a mixture of melamine, formaldehyde and a melamine-formaldehyde initial condensate was obtained. The pH of the aqueous solution was 6–8. This aqueous solution of a mixture of melamine, formaldehyde and melamine-formaldehyde initial condensate is hereinafter referred to as an "initial condensate solution".

The initial condensate solution was added to and mixed with the emulsion prepared above, and after being adjusted to pH 6.0 by a 3.6% solution of hydrochloric acid while stirring, the resulting mixture was heated to 65° C. and stirred for further 360 minutes.

This capsule solution was cooled to room temperature and adjusted to pH 9.0 by adding 2% sodium hydroxide.

To this capsule solution were added 200 parts of a 10% aqueous solution of polyvinyl alcohol and 50 parts of starch particles, and further water was added to adjust the solids content to 20%, thereby preparing a color-former-containing microcapsule coating solution.

This coating solution was coated on a base paper in an amount of 50 g/m$^2$ by the use of an air knife coater in such a manner that the solids were coated in an amount of 5 g/m$^2$ and then dried to prepare a color former-containing microcapsule sheet.

Preparation of Developer Sheet

Developer Sheet A-1

Ten parts of zinc 3,5-bis(α-methylbenzyl)salicylate was added to 20 parts of 1-isopropylphenyl-2phenylethane and dissolved therein by heating at 90° C. The resulting solution was added to 50 parts of a 2% aqueous solution of polyvinyl alcohol (PVA-205 produced by Kuraray Co., Ltd.), and further 0.1 part of a 10% aqueous solution of sodium sulfosuccinate as a surface active agent was addid. The resulting mixture was treated in a homogenizer to form an emulsion (A) having an average particle size of 3 μm.

Five parts of zinc 3,5-bis(α-methybenzyl)salicylate, 170 parts of calcium carbonate, 20 parts of zinc oxide, 1 part of sodium hexamethaphosphate and 200 parts of water were treated in a sand grinder to prepare a uniform dispersion (A) having an average particle size of 3 μm.

Forty parts of the emulsion (A) and 200 parts of the dispersion (A) were mixed. To the resulting mixutre, 100 parts of a 10% aqueous solution of PVA-117 (produced by Kuraray Co., Ltd.) and 10 parts has solids) of a carboxy-modified SBR latex (SN-307 produced by Sumitomo Naugatuc Co., Ltd.) were added and further water was added to adjust the solids content to 20%, thereby preparing a coating solution.

The above coating solution was coated on a base paper in an amount of 50 g/m$^2$ by the use of an air knife coater in such a manner that the solids were coated in an amount of 5.0 g/m$^2$, and then dried to form a developer sheet.

2. Developer Sheet A-2

A developer sheet was prepared in the same manner as in the preparation of the developer sheet A-1 except that zinc 3,5-di-tert-octylsalicylate was used in place of zinc 3,5-bis(α-methylbenzyl)salicylate.

3. Developer Sheet A-3

A developer sheet was prepared :n the same manner as in the preparation of the developer sheet A-1 except that zinc 5-α-(α-methylbenzyl)phenethylsalicylate was used in place of zinc 3,5-bis(α-methylbenzyl)salicylate.

4. Developer Sheet A-4

15 parts of zinc 3,5-di-tert-butylsalicylate, 150 parts of calcium carbonate, 2 parts of activated clay, 20 parts of zinc oxide, 1 part of sodium hexamethaphosphate and 200 parts of water were uniformly dispersed by the use of a sand grinder to prepare a dispersion (B) having an average particle size of 3 μm.

To 400 parts of the dispersion (B), 10 parts of a 10% aqueous solution of PVA-203 (produced by Kurray Co., Ltd.), 100 parts of a 10% aqueous solution of PVA-117 (produced by Kuraray Co., Ltd.) and 10 parts (as solids) of a carboxy-modified SBR latex (SN-307 produced by Sumitomo Naugatuc Co., Ltd.) were added, and further water was added to adjust the solids content to 20%, thereby preparing a coating solution.

The above coating solution was coated on a base paper in an amount of 50 g/m$^2$ by the use of an air knife coater in such a manner that the solids were coated in an amount of 5.0 g/m$^2$ and then dried to form a developer sheet.

5. Developer Sheet B

Ten parts of a paraphenylphenol resin, 100 parts of calcium carbonate, 20 parts of aluminum hydroxide, 1 part of sodium hexamethaphosphate and 200 parts of water were dispersed by the used of a kady mill.

This dispersion was uniformly dispersed in a sand mill in such a manner that the volume average particle size was 3 μm.

To the dispersion thus obtained, 50 parts of a 10% aqueous solution of oxidized starch and 10 parts (as solids) of a carboxy-modified SBR latex were added, and further water was added to that the solids content was 20%, thereby preparing a coating solution.

This coating solution was coated on a base paper in an amount of 50 g/m$^2$ in such a manner that the solids were coated in an amount of 6 g/m$^2$ by the use of an air knife coater and then dried to obtain a developer sheet.

6. Developer Sheet C 200 parts of activated clay was dispersed in 800 parts of water, and the resulting dispersion was adjusted to pH 10.0 by adding a 20% aqueous solution of sodium hydroxide. Then, to the dispersion, 40 parts (as solids) of a styrene-butadiene copolymer latex having a styrene content of 60 mol %, and 60 parts of a 10% aqueous solution of starch were added to prepare a coating solution. This coating solution was coated on a base paper in an amount of 50 g/m$^2$ in such a manner that the solids were coated in an amount of 6 g/m$^2$, by the use of an air knife coater and then dried to form a developer sheet.

The color-former sheets and developer sheets as prepared above were subjected to the following tests.

(1) Hue Test (λ max)

A developer sheet was placed on the microcapsule layer of a color former-containing microcapsule sheet, and a load of 300 kg/cm$^2$ was applied thereon to form color. The sheet assembly was allowed to stand in a dark place for 24 hours. Then a spectral absorption curve in the wavelength range of 380 to 780 nm of a colored image was measured, and the absorption maximum (λ max) and density at the absorption maximum (fresh density Do) were measured.

(2) Color Density Test

A reflective visual density of a colored image after the sheet assembly obtained in (1) above was allowed to stand for 24 hours was measured by the use of a densitometer (Model RD 514 produced by Mabeth Co.). (3) Light Fastness of Colored Image The colored image after the sheet assembly obtained in (1) above was allowed to stand for 24 hours was irradiated with light by the use of a Xenon Fadeometer (FAL-25AX-HC produced by Suga Sikenki Co., Ltd.) for 4 hours. Then the spectral absorption curve of the color former was measured, and the density D at the absorption maximum was determined. The spectral absorption curve was obtained using a Hitachi Color Analyzer Model 307 (produced by Hitachi Ltd.). A value showing light fastness (light fastness value) was calculated from the following equation.

$$\text{Light Fastness Value} = \frac{\text{Density } (D) \text{ at absorption maximum after irradiation}}{\text{Fresh Density } (Do) \text{ at adosorption maximum}}$$

*The greater the light fastness value, the greater the light fastness of the color former.

(4) Plasticizer Resistance Test

After the sheet assembly obtained in (1) above was allowed to stand in a dark place for 24 hours, a soft polyvinyl chloride sheet (thickness: 0.5 mm; containing 15% of dibutyl phthalate and 7% of dioctyl phthalate as plasticizers) was placed on the colored image and then was allowed to stand for 72 hours under a load of 100 g/cm$^2$ in an atmosphere of 50° C. and RH 20%. Then the density at the absorption maximum was measured again, and the ratio of density after superposition of polyvinyl chloride sheet to density before superposition of polyvinyl chloride sheet was referred to as a "plasticizer resistance value".

The results obtained are shown in Table 3.

TABLE 2

| Example No. | Amount of Color Forming Agent (parts by weight) (a) Indolylazaphthalide Compound | | (b) Crystal Violet Lactone | Color Forming Agent Other Than (a) and (b) | Developer Sheet |
|---|---|---|---|---|---|
| Example 1 | Compound (I) | 2.5 | 2.5 | — | A-1 |
| Example 2 | Compound (I) | 3.5 | 1.5 | — | A-1 |
| Example 3 | Compound (I) | 1.5 | 3.5 | — | A-1 |
| Comparative Example 1 | " | | " | — | B |
| Comparative Example 2 | " | | " | — | C |
| Comparative Example 3 | — | | 5.0 | — | A-1 |
| Comparative Example 4 | Compound (I) | 5.0 | — | — | A-1 |
| Example 4 | Compound (I) | 2.0 | 2.0 | Compound (XI) 1.0 | A-1 |
| Example 5 | Compound (I) | 2.5 | 2.5 | — | A-2 |
| Example 6 | " | | " | — | A-3 |
| Example 7 | " | | " | — | A-4 |
| Example 8 | Compound (II) | 2.5 | " | — | A-1 |
| Example 8 | Compound (II) | 2.5 | 2.5 | — | A-1 |
| Comparative Example 5 | " | | " | — | B |
| Comparative Example 6 | " | | " | — | C |
| Comparative Example 7 | Compound (II) | 5.0 | — | — | A-1 |
| Example 9 | Compound (II) | 1.6 | 2.4 | Compound (XII) 1.0 | A-1 |
| Example 10 | Compound (III) | 3.0 | 2.0 | — | A-1 |
| Comparative Example 8 | " | | " | — | B |
| Comparative Example 9 | " | | " | — | C |
| Comparative Example 10 | Compound (III) | 5.0 | — | — | A-1 |
| Example 11 | Compound (III) | 2.4 | 1.6 | Compound (XIII) 1.0 | A-1 |

TABLE 3

| Example No. | Hue | (λmax) | Color Density (V.D.) | Light Fastness of Colored Image (Light Fastness Value) | Plasticizer Resistance of Colored Image (Plasticizer Resistance Value) |
|---|---|---|---|---|---|
| Example 1 | Blue | (615) | 0.66 | 0.82 | 0.90 |
| Example 2 | Blue | (616) | 0.63 | 0.84 | 0.92 |
| Example 3 | Blue | (614) | 0.67 | 0.72 | 0.81 |
| Comparative Example 1 | Blue | (605) | 0.52 | 0.62 | 0.51 |
| Comparative Example 2 | Purple-Blue | (590) | 0.48 | 0.57 | 0.55 |
| Comparative Example 3 | Blue | (610) | 0.63 | 0.43 | 0.40 |
| Comparative Example 4 | Cyan | (620) | 0.50 | 0.84 | 0.93 |
| Example 4 | Blue | (615) | 0.68 | 0.85 | 0.92 |
| Example 5 | Blue | (615) | 0.64 | 0.79 | 0.86 |
| Example 6 | Blue | (615) | 0.65 | 0.80 | 0.88 |
| Example 7 | Blue | (615) | 0.61 | 0.80 | 0.85 |
| Example 8 | Blue | (614) | 0.68 | 0.80 | 0.88 |
| Comparative Example 5 | Blue | (605) | 0.53 | 0.60 | 0.49 |

TABLE 3-continued

| Example No. | Hue | (λmax) | Color Density (V.D.) | Light Fastness of Colored Image (Light Fastness Value) | Plasticizer Resistance of Colored Image (Plasticizer Resistance Value) |
|---|---|---|---|---|---|
| Comparative Example 6 | Purple-Blue | (590) | 0.51 | 0.53 | 0.53 |
| Comparative Example 7 | Cyan | (620) | 0.50 | 0.82 | 0.91 |
| Example 9 | Blue | (614) | 0.70 | 0.81 | 0.90 |
| Example 10 | Blue | (616) | 0.64 | 0.81 | 0.90 |
| Comparative Example 8 | Blue | (605) | 0.54 | 0.65 | 0.53 |
| Comparative Example 9 | Purple-Blue | (590) | 0.52 | 0.56 | 0.55 |
| Comparative Example 10 | Cyan | (620) | 0.52 | 0.83 | 0.92 |
| Example 11 | Blue | (616) | 0.65 | 0.81 | 0.91 |

Compound (XI)

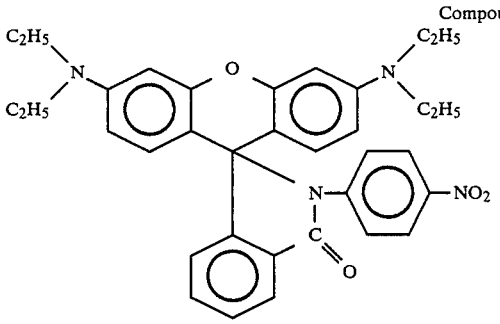

Compound (XII)

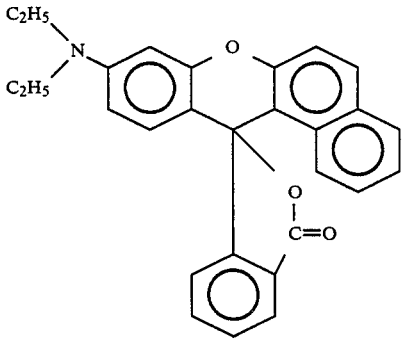

Compound (XIII)

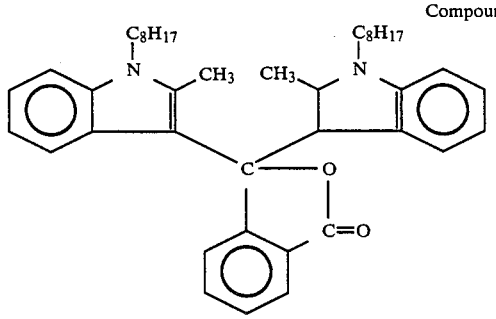

As apparent from the results of Table 3, when the color former sheet and developer sheet of the present invention, there can be obtained a colored image which is superior in light fastness and plasticizer resistance to that of the comparative sheets and is excellent in hue and color density.

While the invention has been described in detail and with reference to specific embodiments thereof, it will be apparent to o ne skilled in the art that various changes and modifications can be made therein without departing from the spirit and scope thereof.

What is claimed is:

1. A pressure-sensitive recording medium which produces a colored image comprising a support having provided thereon a substantially colorless electron donating dye precursor layer and an electron accepting developer layer, wherein the electron accepting developer layer contains a metal salt of a salicylic acid derivative and the electron donating dye precursor layer contains (a) an indolylazaphthalide compound represented by the following formula:

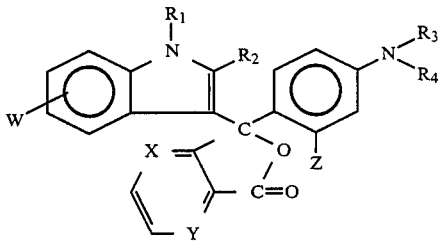

wherein one of X and Y represents —N═ and the other represents —CH═, Z represents a hydrogen atom, a halogen atom, an alkyl group having from 1 to 8 carbon atoms, an alkoxy group having from 1 to 12 carbon atoms, an aryloxy group having from 6 to 18 carbon atoms, or an aralkyloxy group having from 7 to 8 carbon atoms, W represents a hydrogen atom or a halogen atom, $R_1$ represents a hydrogen atom or an alkyl group having not more than 12 carbon atoms which is unsubmitted or substituted with a halogen atom, a hydroxyl group, a cyano group, or a lower alkoxy group, $R_2$ represents a hydrogen atom, an alkyl group having from 1 to 8 carbon atoms; or a phenyl group, $R_3$ and $R_4$ each independently represents a hydrogen atom or an alkyl group, a cycloalkyl group having from 5 to 7 carbon atoms, a benzyl group, or a phenyl group which is unsubstituted or substituted with a halogen atom, a hydroxyl group, a cyano group, or a lower alkoxy group or $R_3$ and $R_4$ are combined to form a pyrrolidinyl group and (b) Crystal Violet lactone.

2. The pressure-sensitive recording medium as claimed in claim 1, wherein said aromatic carboxylic acid metal salt has a hydroxyl group in the ortho- or paraposition relative to the carboxyl group.

3. The pressure-sensitive recording medium as claimed in claim 2, wherein said aromatic carboxylic acid metal salt has a substituent in at least one of the other para-positions relative to the hydroxyl group which has a total number of carbon atoms of not less than 8.

4. The pressure-sensitive recording medium as claimed in claim 1, wherein the indolylazaphthalide and the Crystal Violet lactone are present in the electron donating dye precursor layer in the range from 5 parts indolylazaphthalide to 95 parts Crystal Violet lactone by weight to 90 parts indolylazaphthalide to 10 parts Crystal Violet lactone by weight.

5. The pressure-sensitive recording medium as claimed in claim 4, wherein one or more color formers other than the combination of indolylazaphthalide and the Crystal Violet lactone is present in the electron donating dye precursor layer, the indolylazaphthalide and the Crystal Violet lactone together being present in the electron donating dye precursor layer in an amount not less than 60 percent by weight of the total weight of the color formers present in the pressure-sensitive recording medium.

6. The pressure-sensitive recording medium as claimed in claim 5, wherein the amount of aromatic carboxylic acid metal salt present in the electron accepting developer layer is in the range of from 0.1 to 3.0 $g/m^2$ 7. The pressure-sensitive recording medium as claimed in claim 1, wherein the electron accepting developer layer is a support which is coated with a coating solution mixed with a binder, said coating solution comprising a dispersion or emulsion, or a mixture of a dispersion and an emulsion, of said aromatic carboxylic acid metal salt.

8. The pressure-sensitive recording medium as claimed in claim 7, said coating solution further comprising an inorganic pigment.

* * * * *